US009615675B2

(12) United States Patent
Camello et al.

(10) Patent No.: US 9,615,675 B2
(45) Date of Patent: Apr. 11, 2017

(54) SYSTEM FOR DISPLAYING PRODUCTS ON A SHELF

(75) Inventors: Anthony Camello, Staten Island, NY (US); Eric Neumann, Scotch Plains, NJ (US); Bruce Gommermann, Northport, NY (US); Daniel C. Riley, Hackensack, NJ (US)

(73) Assignee: Display Technologies, LLC, Lake Success, NY (US)

( * ) Notice: Subject to any disclaimer, the term of this patent is extended or adjusted under 35 U.S.C. 154(b) by 808 days.

(21) Appl. No.: 13/406,949

(22) Filed: Feb. 28, 2012

(65) Prior Publication Data

US 2012/0266437 A1 Oct. 25, 2012

Related U.S. Application Data

(63) Continuation-in-part of application No. 12/482,169, filed on Jun. 10, 2009, now abandoned.

(Continued)

(51) Int. Cl.

| | |
|---|---|
| ***A47F 1/12*** | (2006.01) |
| ***A47F 7/28*** | (2006.01) |
| ***A47F 5/00*** | (2006.01) |

(52) U.S. Cl.

CPC ..... *A47F 1/125* (2013.01); *A47F 1/126* (2013.01); *A47F 5/005* (2013.01); *A47F 7/28* (2013.01); *Y10T 29/49826* (2015.01)

(58) Field of Classification Search

USPC ..... 211/59.2, 59.3, 59.4, 15, 74, 76; 312/60, 312/71, 72, 73; 221/194, 226

See application file for complete search history.

(56) References Cited

U.S. PATENT DOCUMENTS 2,620,691 A * 12/1952 Gould ..... 81/3.08
2,649,207 A 8/1953 Shield (Continued)

FOREIGN PATENT DOCUMENTS

WO 2009152246 A1 12/2009

OTHER PUBLICATIONS

International Search Report for PCT/US2009/046908 dated Jul. 30, 2009.

(Continued)

*Primary Examiner* — Stanton L Krycinski
(74) *Attorney, Agent, or Firm* — Carter, DeLuca, Farrell & Schmidt, LLP

(57) ABSTRACT

A product display unit for a displaying a plurality of products thereon is disclosed. The product display unit comprises a bottom member, a first rib, a second rib and a top member. The bottom member is configured to be positioned on a first product-supporting shelf. The first rib projects upwardly from the product-supporting surface and extends longitudinally along the bottom member. The second rib projects upwardly from the product-supporting surface and extends longitudinally along the bottom member, such that a distance is defined between the first rib and the second rib. The top member is disposed in juxtaposed relation with the bottom member and is configured for suspension from a second product-supporting shelf. The distance between the first rib and the second rib is dimensioned to be less than the widest portion of a product configured to be supported by the bottom member.

17 Claims, 15 Drawing Sheets

Related U.S. Application Data

(60) Provisional application No. 61/060,330, filed on Jun. 10, 2008.

(56) References Cited

U.S. PATENT DOCUMENTS

| | | | | | |
|---|---|---|---|---|---|
| 4,066,625 | A | | 1/1978 | Bolger | |
| 4,099,625 | A | | 7/1978 | Bustos | |
| 4,228,903 | A | | 10/1980 | Eckert | |
| 4,228,905 | A | * | 10/1980 | Cammarota | 211/41.2 |
| 4,318,485 | A | * | 3/1982 | Clement | 211/59.2 |
| 4,367,818 | A | * | 1/1983 | Suttles | 211/59.2 |
| 4,401,221 | A | * | 8/1983 | Suttles | 211/59.2 |
| 4,565,725 | A | | 1/1986 | Spamer et al. | |
| 4,909,401 | A | * | 3/1990 | McConnell | 211/74 |
| 5,240,125 | A | | 8/1993 | Kunz | |
| 5,586,665 | A | * | 12/1996 | Brousseau | 211/59.2 |
| 5,645,176 | A | | 7/1997 | Jay | |
| 5,685,664 | A | | 11/1997 | Parham et al. | |
| 5,695,075 | A | * | 12/1997 | Flum et al. | 211/59.2 |
| 5,706,956 | A | | 1/1998 | Headrick et al. | |
| 5,706,958 | A | * | 1/1998 | Spamer | 211/59.2 |
| 5,755,341 | A | * | 5/1998 | Spamer | 211/59.2 |
| 5,779,068 | A | * | 7/1998 | Whiten et al. | 211/117 |
| 5,785,189 | A | | 7/1998 | Gollob et al. | |
| 5,878,894 | A | * | 3/1999 | Robertson | 211/59.2 |
| 5,992,650 | A | | 11/1999 | Lord | |
| 6,059,125 | A | * | 5/2000 | Parham | 211/59.2 |
| 6,155,438 | A | | 12/2000 | Close | |
| 6,189,734 | B1 | * | 2/2001 | Apps et al. | 221/193 |
| 6,237,784 | B1 | | 5/2001 | Primiano | |
| 6,360,901 | B1 | * | 3/2002 | Parham | 211/59.2 |
| 6,398,044 | B1 | | 6/2002 | Robertson | |
| 6,478,167 | B1 | | 11/2002 | Burgess | |
| 6,635,609 | B2 | | 10/2003 | Sutton | |
| 6,672,464 | B2 | | 1/2004 | Robertson | |
| 6,766,911 | B2 | * | 7/2004 | Higgins | 211/59.2 |
| 7,086,541 | B2 | | 8/2006 | Robertson | |
| 7,802,697 | B2 | * | 9/2010 | Martin | 221/193 |
| 2002/0166827 | A1 | * | 11/2002 | Robolin | 211/74 |
| 2004/0020879 | A1 | | 2/2004 | Close | |
| 2007/0228242 | A1 | * | 10/2007 | Martin | 248/317 |
| 2012/0266437 | A1 | | 10/2012 | Camello et al. | |

OTHER PUBLICATIONS

Chinese Office Action dated Oct. 10, 2015 in corresponding Chinese Application No. 2013100628105.

Australian Examination Report dated Mar. 27, 2015 in corresponding Australian Application No. 2009257537.

Australian Re-Examination Report dated Oct. 21, 2015, 2015 in corresponding Australian Application No. 2013200980.

European Search Report dated Mar. 4, 2016 in corresponding EP Application No. 15001959.4-1653.

* cited by examiner

SYSTEM FOR DISPLAYING PRODUCTS ON A SHELF

CROSS-REFERENCE TO RELATED APPLICATIONS

The present application is a Continuation-In-Part of U.S. patent application Ser. No. 12/482,169 filed on Jun. 10, 2009, which claims the benefits of and priority to U.S. Provisional Patent Application Ser. No. 61/060,330 filed on Jun. 10, 2008. The entire contents of each of which being herein incorporated by reference in their entirety.

BACKGROUND

The present disclosure relates generally to displaying products on a shelf. More particularly, the present disclosure relates to a system for optimizing the number of products displayable on a shelf.

Various types of product displays are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a user once the lead product has been removed from the shelf. As can be appreciated, such product displays facilitate the arrangement and upkeep of products, as the trailing products don't have to be manually moved towards the front of the shelf, for instance.

Additionally, it is often desirable to maximize the amount of products a retailer can display on a single shelf. More specifically, retailers generally want as many products to fit side-by-side (or horizontally) on a shelf as possible to take full advantage of all of the shelf space (e.g., in a refrigerated display).

SUMMARY

The present disclosure relates to a product display unit for a displaying a plurality of products thereon. The product display unit comprises a bottom member, a first rib, a second rib, and a top member. The bottom member includes a product-supporting surface. The bottom member is configured to be positioned on a first product-supporting shelf. The first rib projects upwardly from the product-supporting surface and extends longitudinally along the bottom member. The second rib projects upwardly from the product-supporting surface and extends longitudinally along the bottom member, such that a distance is defined between the first rib and the second rib. The top member is disposed in juxtaposed relation with the bottom member and is configured for suspension from a second product-supporting shelf. The top member includes a longitudinally extending channel having a width. The smallest width of the channel is greater than the width of a top-most portion of a product configured to be supported by the bottom member. The distance between the first rib and the second rib is dimensioned to be less than the widest portion of a product configured to be supported by the bottom member between the first rib and the second rib.

The present disclosure also relates to a system for displaying bottles. The system comprises a first product-supporting shelf, a second product-supporting shelf, at least one bottom member, and at least one top member. The second product-supporting shelf is vertically spaced apart from the first product-supporting shelf and is disposed substantially parallel with respect to the first product-supporting shelf. The at least one bottom member includes a product-supporting surface and is configured for positioning on the first product-supporting shelf. The at least one top member is configured for suspension from the second product-supporting shelf. The top member includes a longitudinally extending channel having a width. The channel is configured to guide a top-most portion of a product configured to be supported by the bottom member.

BRIEF DESCRIPTION OF DRAWINGS

Embodiments of the present disclosure are described hereinbelow with reference to the drawings wherein.

DESCRIPTION

Figure 1:
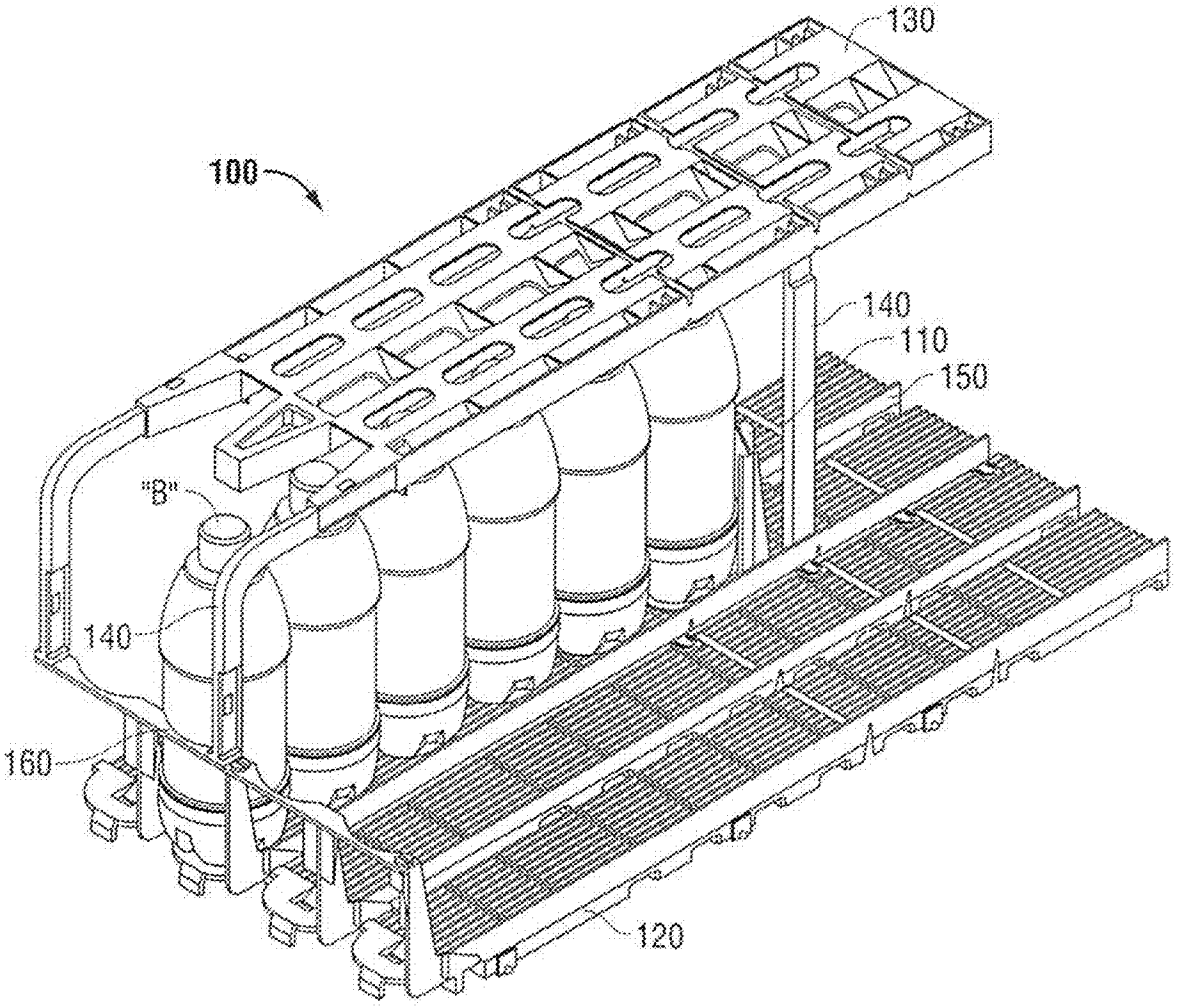
FIG. 1 is a perspective view of a system for displaying items on a shelf according to embodiments of the present disclosure illustrated with bottles thereon.
Figure 2:
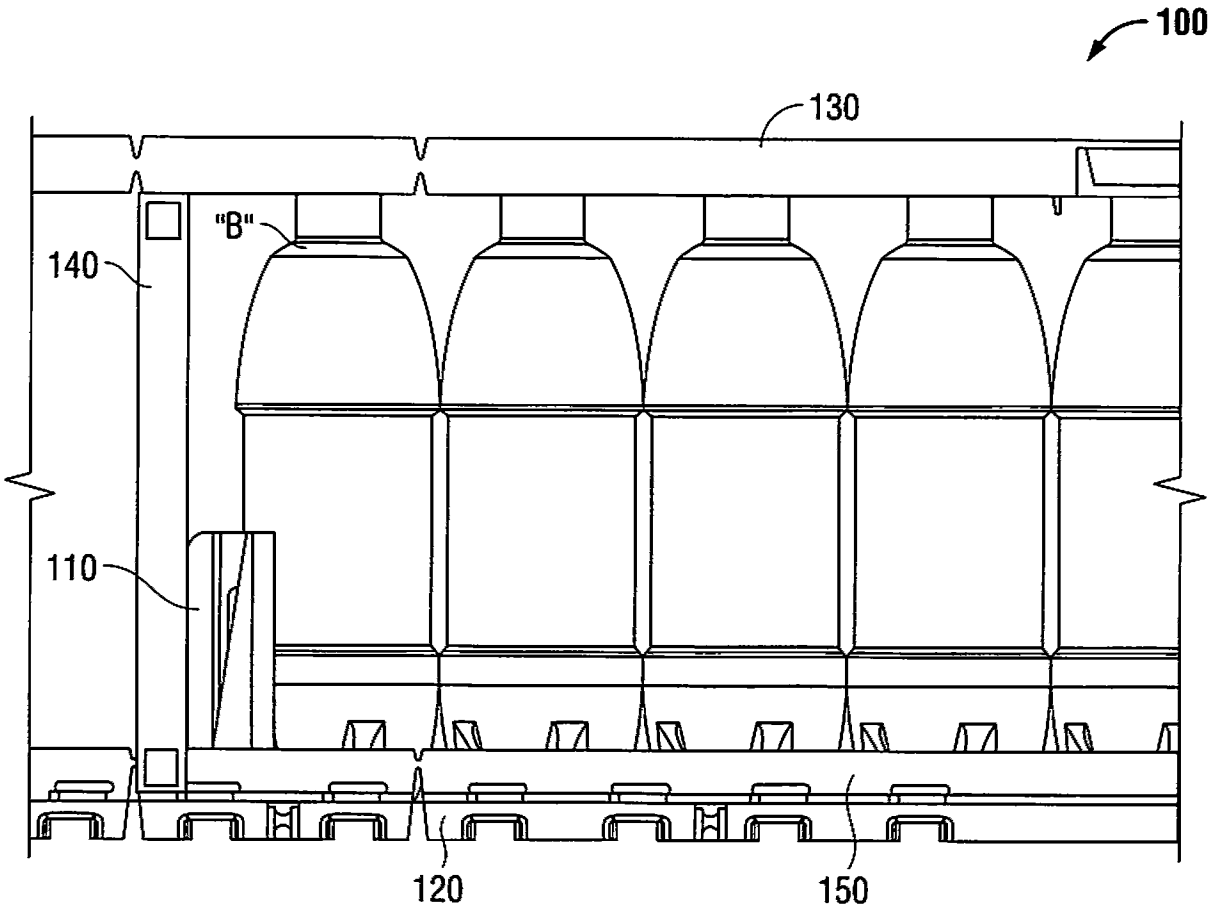
FIG. 2 is a side view of a portion of the system illustrated in FIG. 1.

Embodiments of the presently disclosed system for displaying products are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

In combination with the accompanying FIGS. 1-6, a system 100 for displaying products of the present disclosure is described herein. In the illustrated embodiments, system 100 is shown having a plurality of bottles "B" thereon. As can be appreciated, the items displayed by system 100 are not limited to bottles, as any suitable product can be used with system 100.

System 100 can be used to display/dispense bottles "B" (or other suitable objects) on a flat shelf and/or a declined shelf (or inclined). As can be appreciated, when system 100 is used on a flat (or inclined) shelf, a pusher 110 (e.g., spring loaded) may be used with system 100 to help urge the bottles "B" proximally towards the user. When system 100 is used on a declined shelf (i.e., angled downward towards the user), system 100 does not necessarily include a pusher 110. In such embodiments, the bottles "B" are gravity fed proximally. Although pusher 110 is shown and described in connection with the illustrated embodiments, the present disclosure includes system 100 without a pusher. Further, the disclosed shelves can support products and/or a plurality of bottom members 200, 2000. In either case, shelf may be referred to herein as a product-supporting shelf.

As shown in the accompanying figures, system 100 includes pusher 110, a bottom member 120, a top member 130, support members 140, ribs 150 and a proximal rail 160. Bottom member 120 is configured to support a plurality of products (e.g., bottles "B") thereon. Top member 130 is configured to help guide a top portion of the products (e.g., the cap/neck area of a bottle "B") in a distal-to-proximal direction. Support members 140 are engagable with bottom member 120 and top member 130, and are configured to support top member 130 above bottom member 120.

As can be appreciated, support members 140 may be configured in varying heights "h," such that system 100 can display products of various heights. Additionally, support members 140 may be configured in various widths "w" (i.e., the width between adjacent ribs 150), such that system 100 can display products of various widths.

Figure 3:
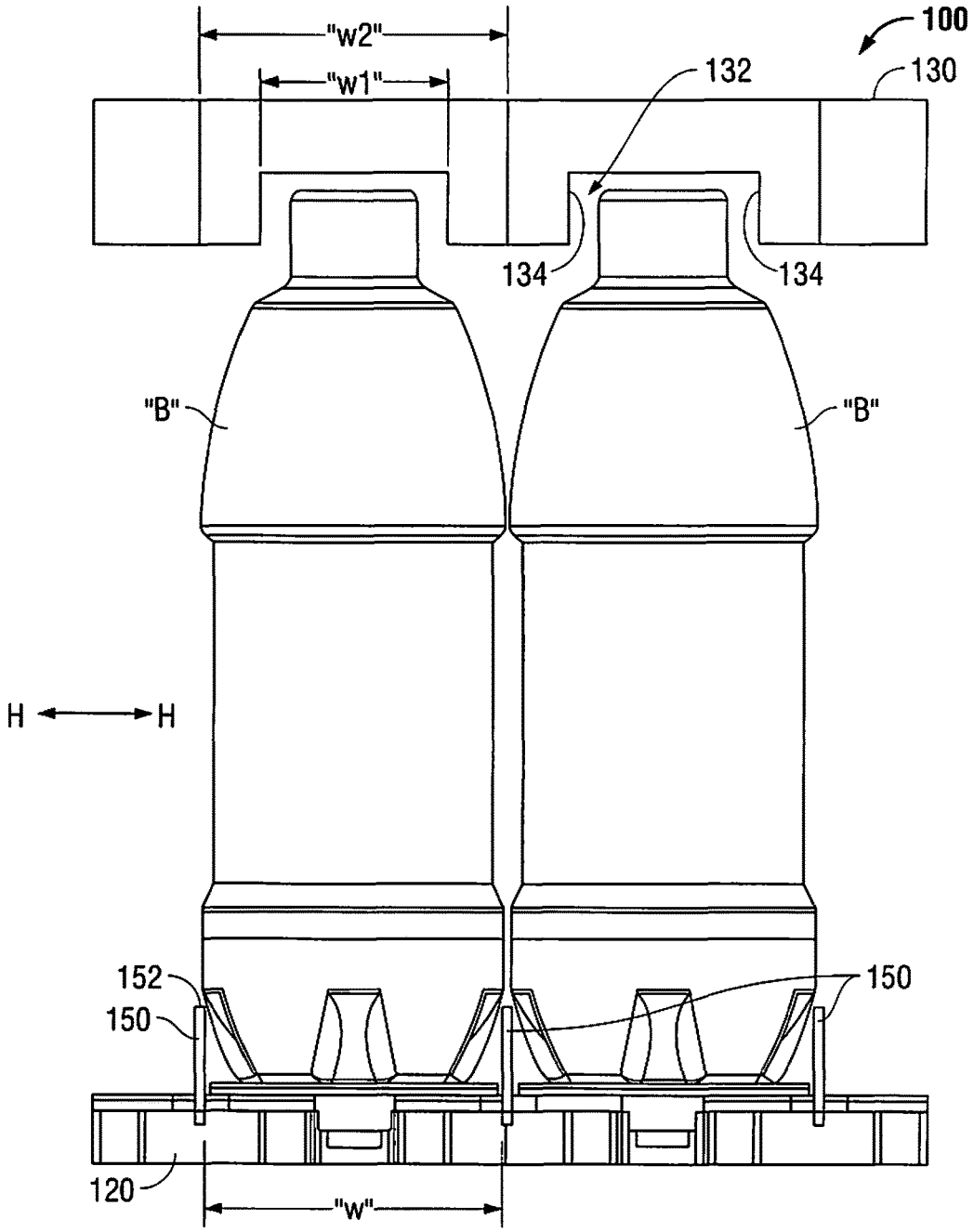
FIG. 3 is a front view of two bottles side-by-side on a portion of the system illustrated in FIGS. 1 and 2.
Figure 4:
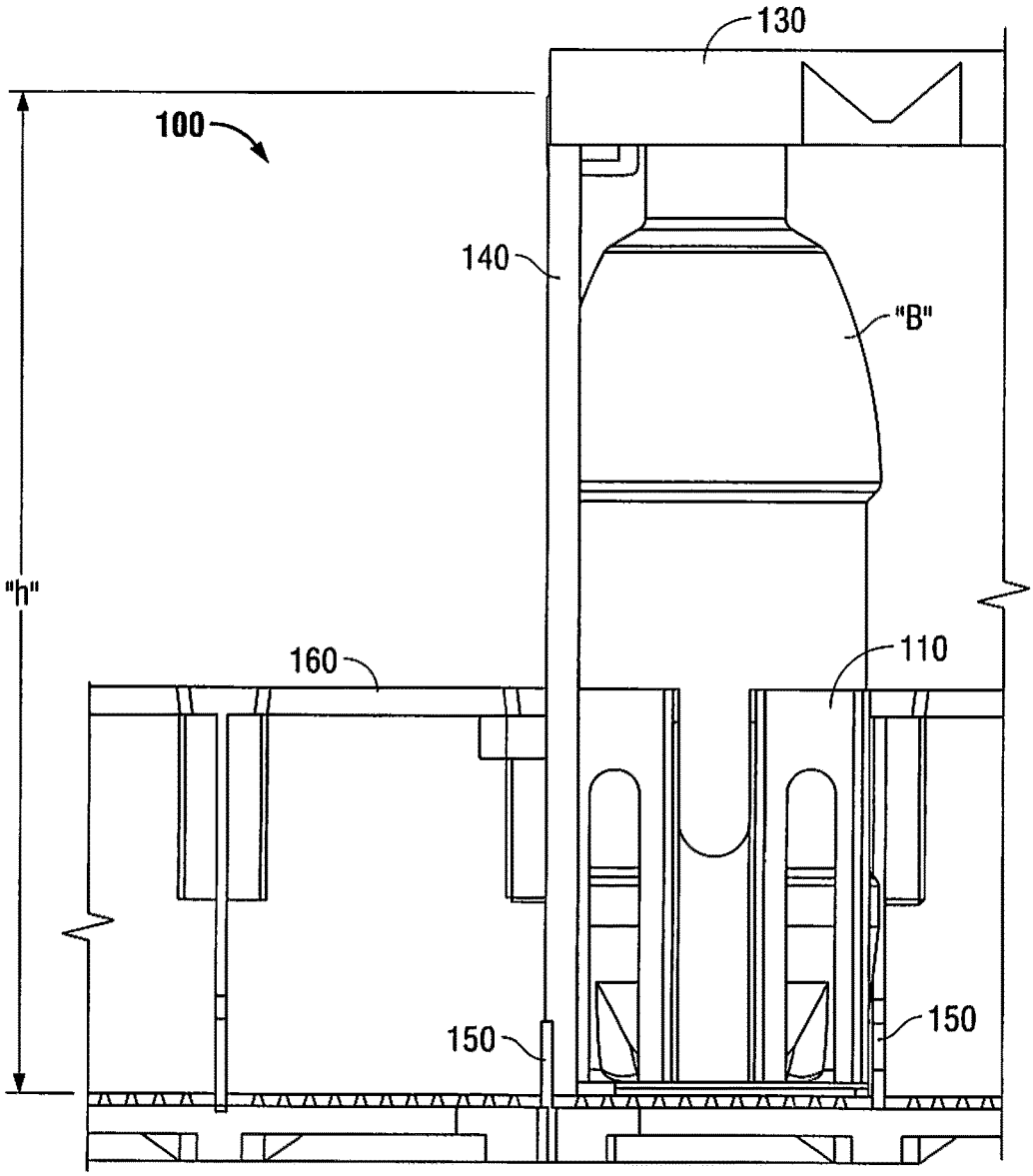
FIG. 4 is a rear view of a portion of the system illustrated in FIGS. 1-3.
Figure 5:
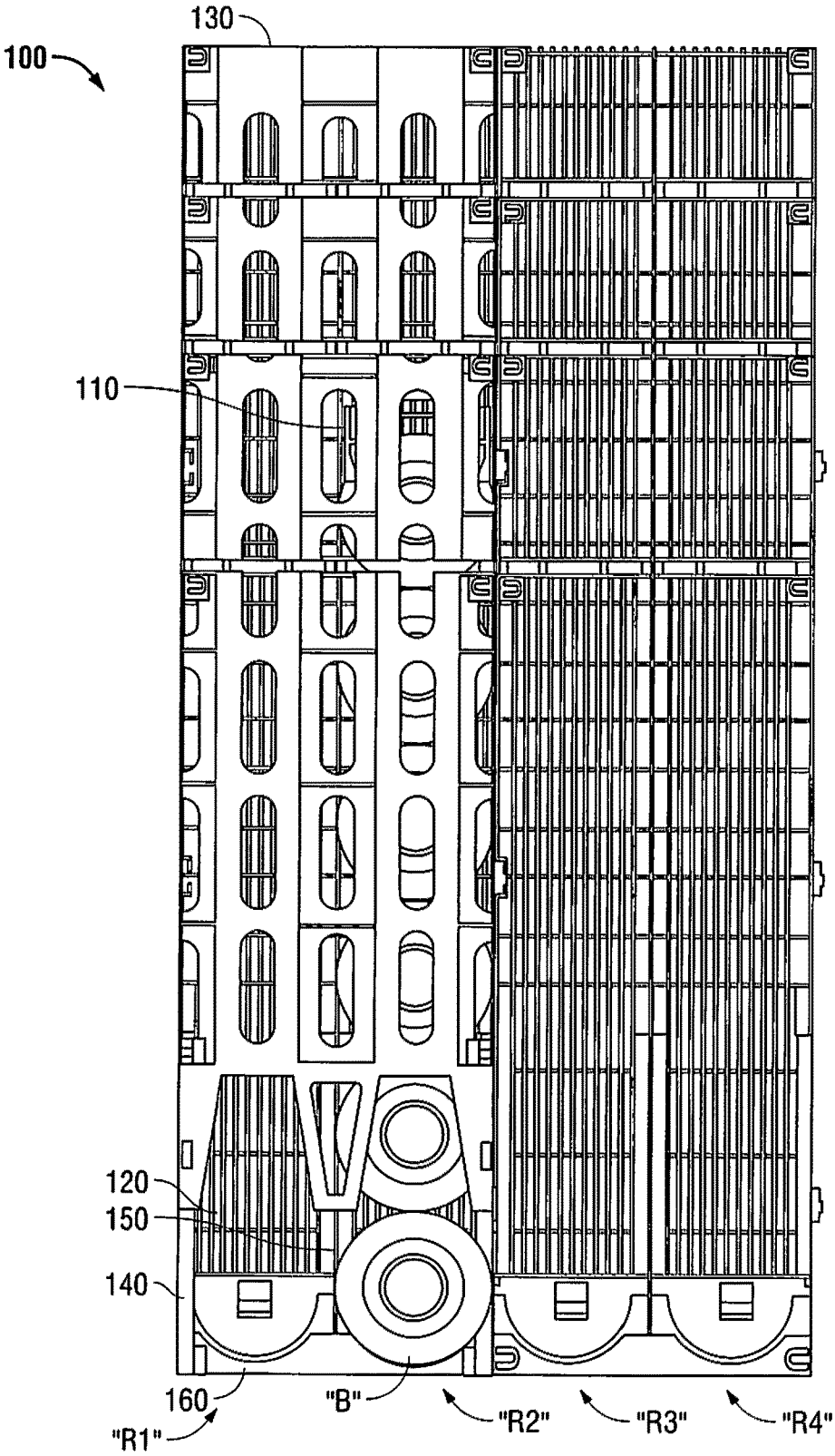
FIG. 5 is a top view of the system illustrated in FIGS. 1-4.
Figure 6:
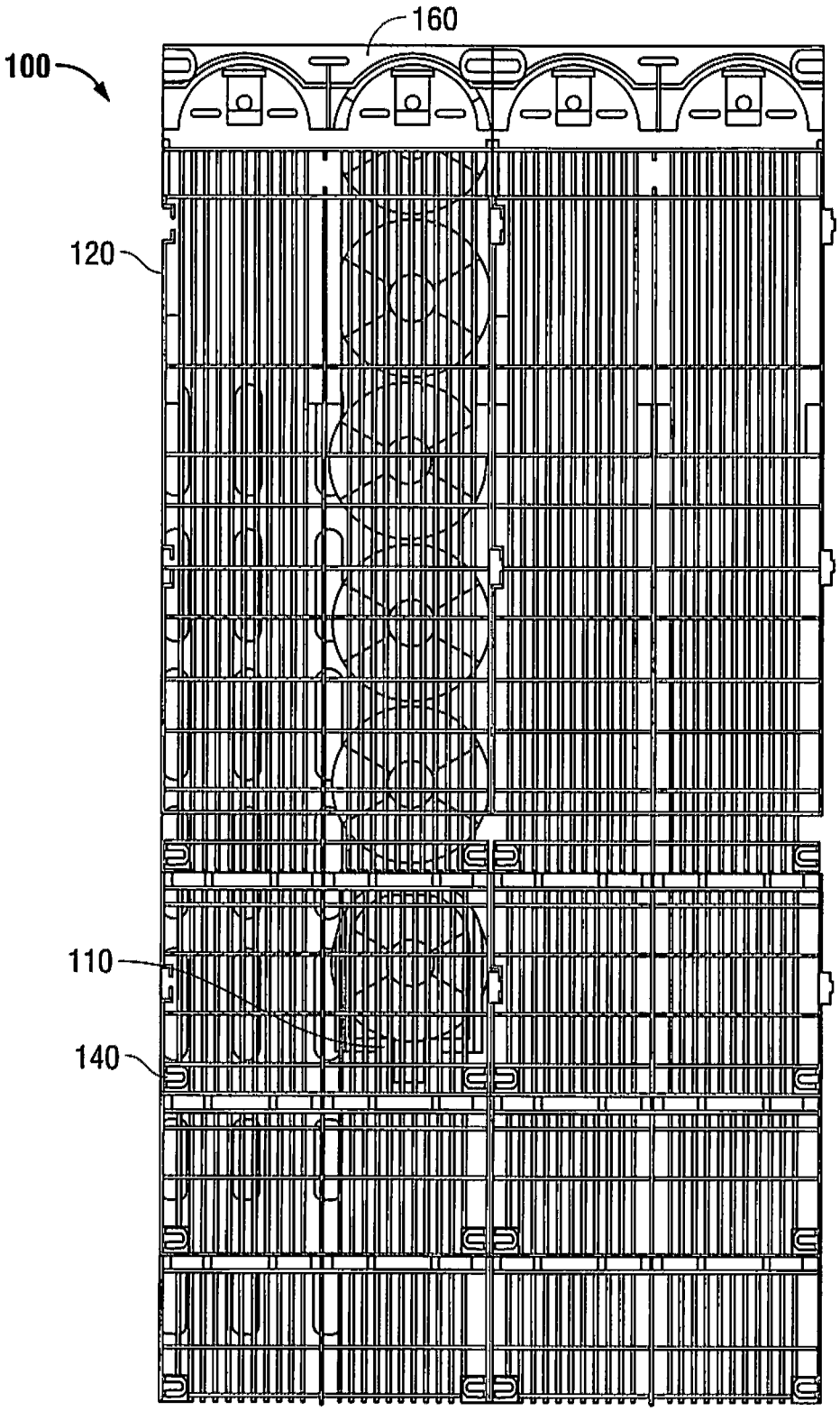
FIG. 6 is a bottom view of the system illustrated in FIGS. 1-5.

With particular reference to FIG. 3, ribs 150 extend from bottom member 120 towards top member 130 and are configured to help maintain bottles "B" on bottom member 120 (i.e., to help prevent bottles "B" from moving horizontally off of bottom member 120 or towards an adjacent bottom member 120). Proximal rail 160 (see FIG. 1, for example) is configured to resist the force of pusher 110 and/or gravity, thus helping prevent the products from falling proximally off of the shelf.

More particularly, ribs 150 are configured such that they project upwardly from bottom member 120 and extend longitudinally therealong. Ribs 150 project upwardly from bottom member 120 a distance that enables horizontally adjacent bottles "B" to contact (or substantially contact) one another. That is, ribs 150 are sized such that the entire rib 150, including its upper-most edge 152, is able to fit under the widest portion of the bottle "B," thus allowing the rib 150 to take advantage of the space produced by the contour of the bottle "B." More particularly, the distance (i.e., width "w") between adjacent ribs 150 is dimensioned to be less than the widest portion of the product held on the bottom member 120 between the same adjacent ribs 150.

In envisioned embodiments, upper-most edge 152 of rib 150 extends between about 0.25 inches and about 1.25 inches from a product-supporting surface 122 of bottom member 120 (i.e., the height of rib). For example, it is envisioned that the height of rib 150 may be approximately equal to 0.6875 inches. It is also envisioned that system 100 can be used to display a product that does not include such a contour. In such uses, ribs 150 would contact the widest portion of the products, as opposed to being positioned beneath the widest portion.

It is envisioned that ribs 150 are integrally formed with bottom member 120 and/or are configured to mechanically engage bottom member 120 (e.g., via a snap fit connection, or other suitable means). It is also envisioned that system 100 includes interchangeable ribs 150 of various sizes, such that system 100 is usable with a variety of products. For example, it is envisioned that system 100 includes one set of ribs 150 that include a height of between about 0.25 inches and about 0.75 inches and a second set of ribs that include a height of between about 0.75 inches and about 1.25 inches.

As discussed above, top member 130 is configured to help guide a top portion of the products in a distal-to-proximal direction. More particularly, top member 130 includes a channel 132 longitudinally extending therealong. Channel 132 is defined by a pair of channel walls 134 on either side. The width "w1" of channel 132 is dimensioned to allow the neck area of a product or bottle (e.g., the cap of the bottle) to fit therein and to freely slide along the length of channel 132.

It is envisioned that a single top member 130 is used to guide a plurality of horizontally adjacently positioned products, or that a single top member 130 is used to guide a single row (e.g., "R1," "R2," "R3," etc.) of products. In both embodiments, top member 130 is configured such that the width "w2" of top member 130 associated with a single row of products is dimensioned to be less than or equal to (i.e., not wider than) the widest portion of a product (e.g., bottle "B") configured to be supported by bottom member 120.

Thus, ribs 150 and top member 130 are configured to allow products in horizontally adjacent rows and/or columns to contact (or substantially contact) one another. Consequently, the components of system 100 do not utilize any (or essentially any) valuable horizontal shelf space (i.e., in the direction of arrow "H-H" in FIG. 3).

Support members 140 may be configured and spaced as illustrated or may be arranged and sized in any other suitable manner. As shown, the proximal-most support member 140 may include a curved corner to help facilitate access to the proximal-most product.

It is also envisioned that system 100 could be configured to hold and display a plurality of rows of products. As such, system 100 may include several rows of bottom members 120, top members 130, and ribs 150 that are either integrally connected, connectable, adjacently positionable or any combination thereof. Further, several systems 100 may be placed side-by-side on a shelf. Still further, system 100 may be configured such that another system 100 (or other suitable product display device) may be stacked on top of first system 100.

The versatility of system 100 is further appreciated in envisioned embodiments, as portions of the disclosed system 100 are usable without other portions of the system 100. For example, depending on the type of product or products a user wishes to display, a user can use bottom member 120, ribs 150 and proximal rail 160, without support members 140 and top members 130. To facilitate such a contemplated use, various components may be readily connectable (e.g., via a snap-fit connection or other suitable means) with other components. For instance, support members 140 may be connectable with top member 130, proximal rail 160 and/or bottom member 120. Additionally, it is envisioned that another type of top member 130 (e.g., a top member 130 without structure for guiding the cap/neck area of a bottle "B") may be used in combination with other components of system 100.

With reference to FIGS. 7-15, a second system 1000 for displaying products is shown. System 1000 includes a bottom member 2000 for engaging the bottom portion of a product (e.g., a beverage bottle "B") and a top member 3000 for engaging the top portion or neck of the product.

Figure 7:
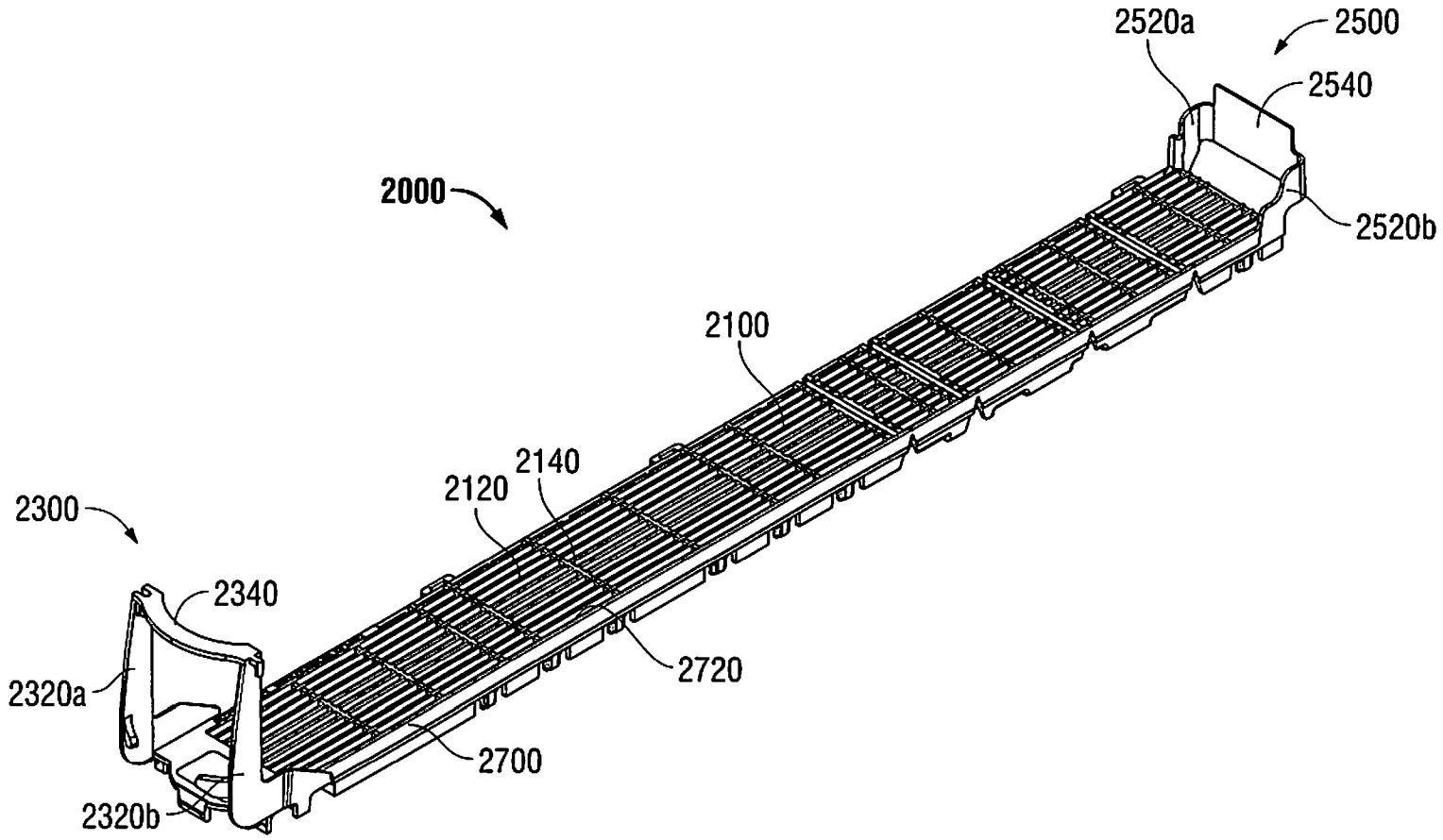
FIG. 7 is a perspective view of a bottom member in accordance with an embodiment of the present disclosure.
Figure 8:
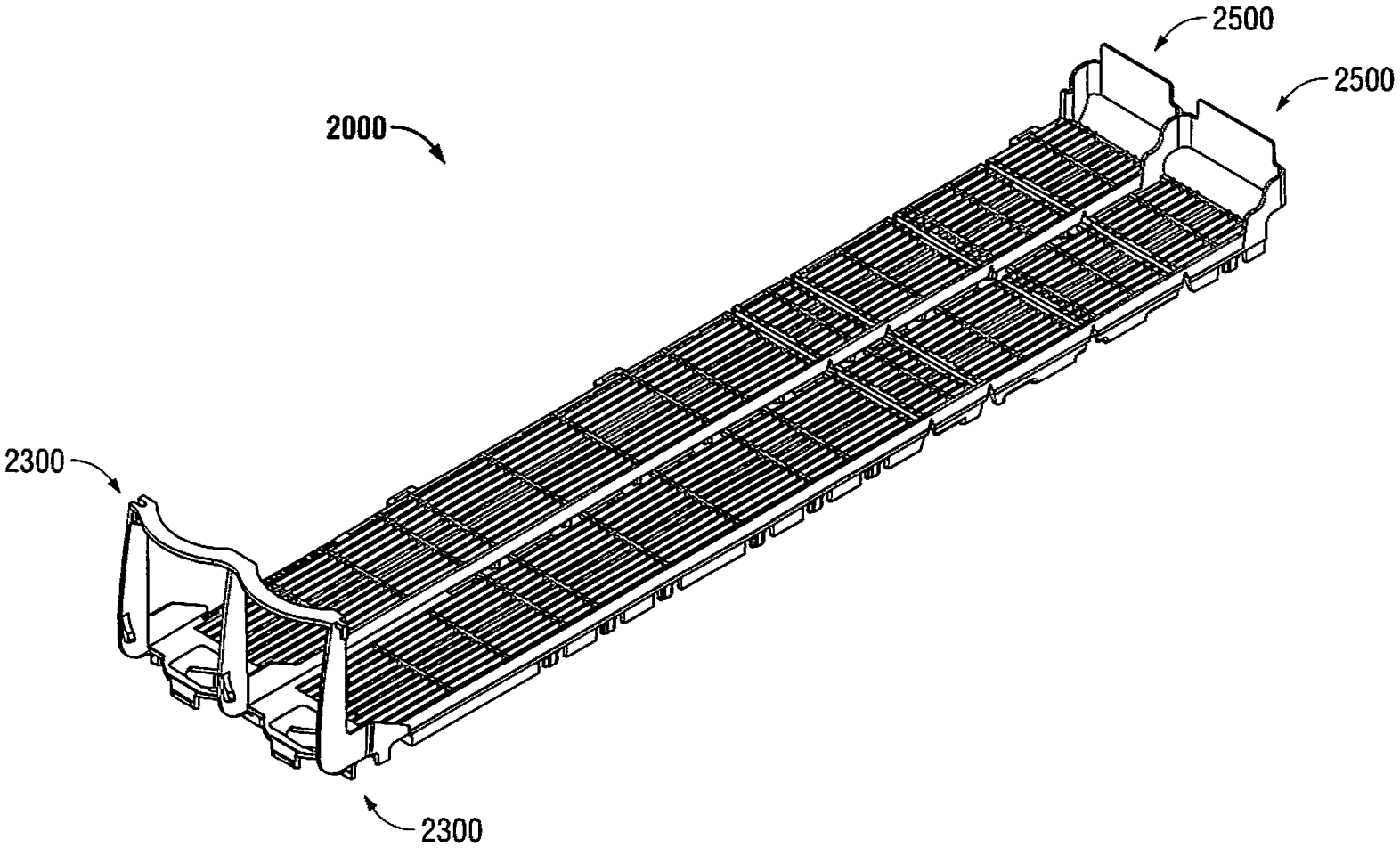
FIGS. 8 and 9 are perspective views of a plurality of the bottom members of FIG. 7 position adjacent each other.
Figure 9:
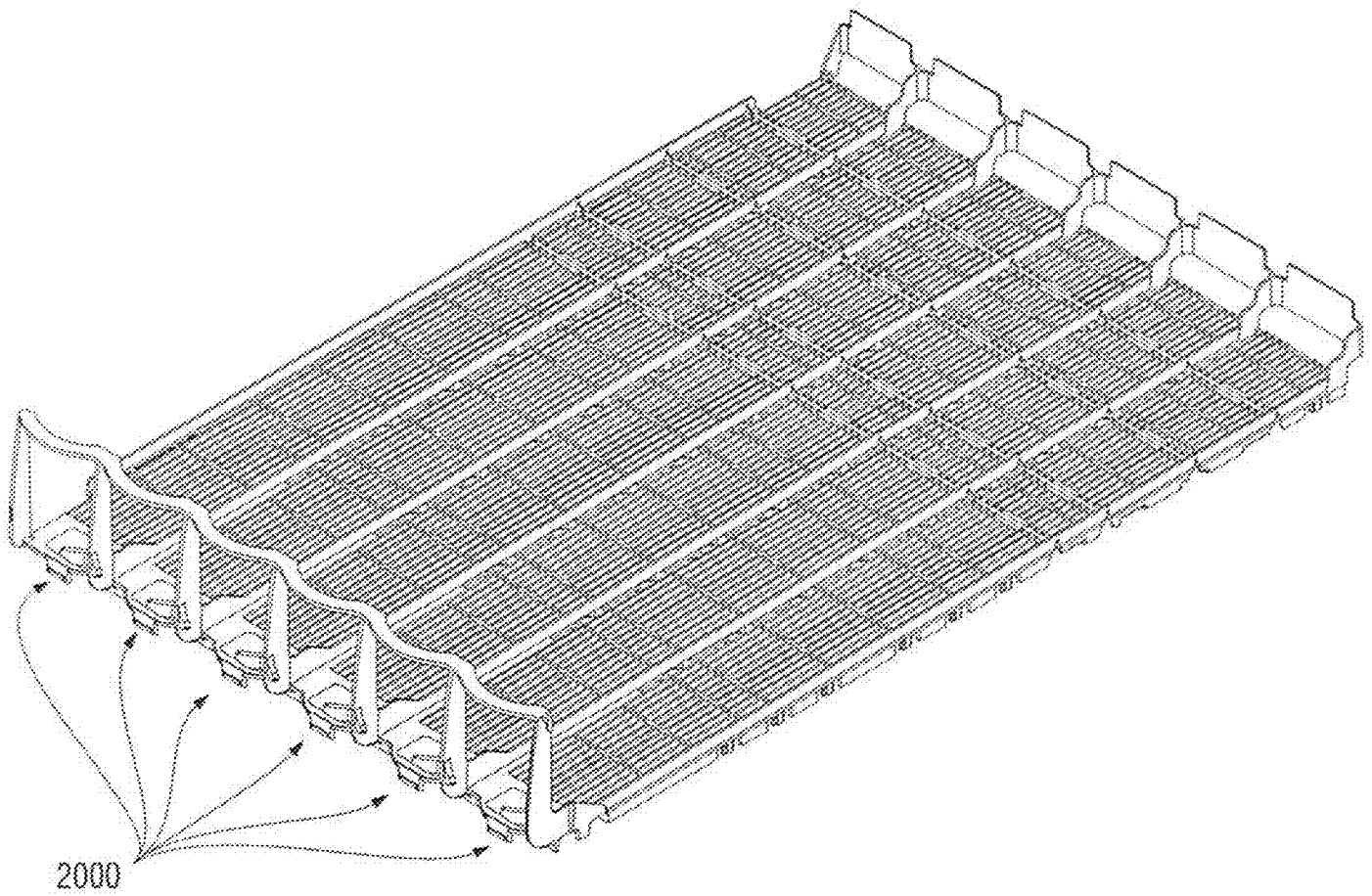
Figure 14:
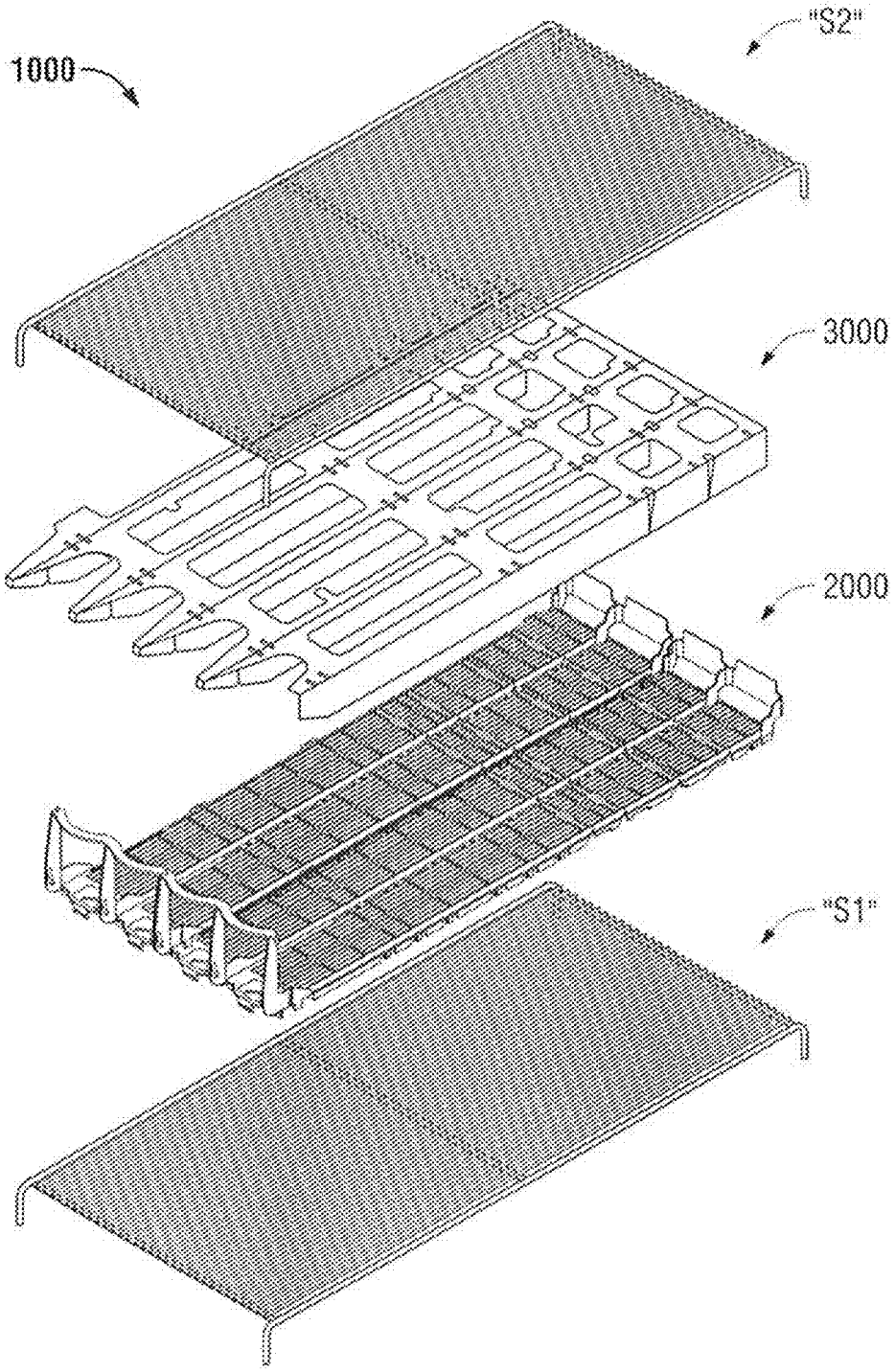
FIG. 14 is an assembly view, with parts separated, of a system for displaying items on a shelf including a plurality of bottom members of FIG. 7, a plurality of top members of FIG. 13, a first shelf and a second shelf.
Figure 15:
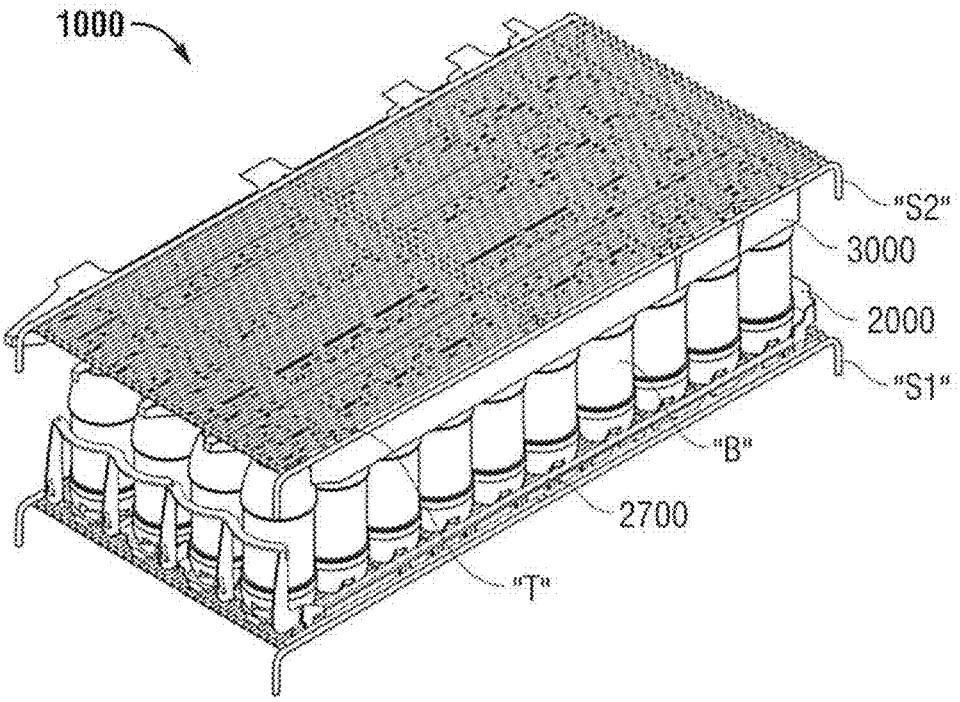
FIG. 15, is an assembled view of the system of FIG. 14.

The bottom member 2000 is configured to support a plurality of products thereon. With particular reference to FIG. 7, the bottom member 2000 includes a product-supporting surface 2100, a proximal rail 2300, a distal rail 2500, and a longitudinally-extending rib 2700. The product-supporting surface 2100 includes longitudinally-extending members 2120 and transversely-extending members 2140, which form a grid-like pattern. In use, several bottom members 2000 are placed side-by-side, as shown in FIGS. 8 and 9, and positioned on a first shelf "S1" (FIGS. 14 and 15).

The proximal rail 2300 extends upwardly from the proximal end of the product-supporting surface 2100 and is configured to help prevent products from falling off of the proximal end of the bottom member 2000. The proximal rail 2300 includes a pair of vertical arms 2320*a*, 2320*b*, and a horizontal member 2340 supported by and extending between the vertical arms 2320*a*, 2320*b*. When several bottom members 2000 are placed side-by-side, the first vertical arm 2320*a* of a first bottom member 2000 interlocks with the second vertical arm 2320*b* of an adjacent bottom member 2000.

Figure 10:
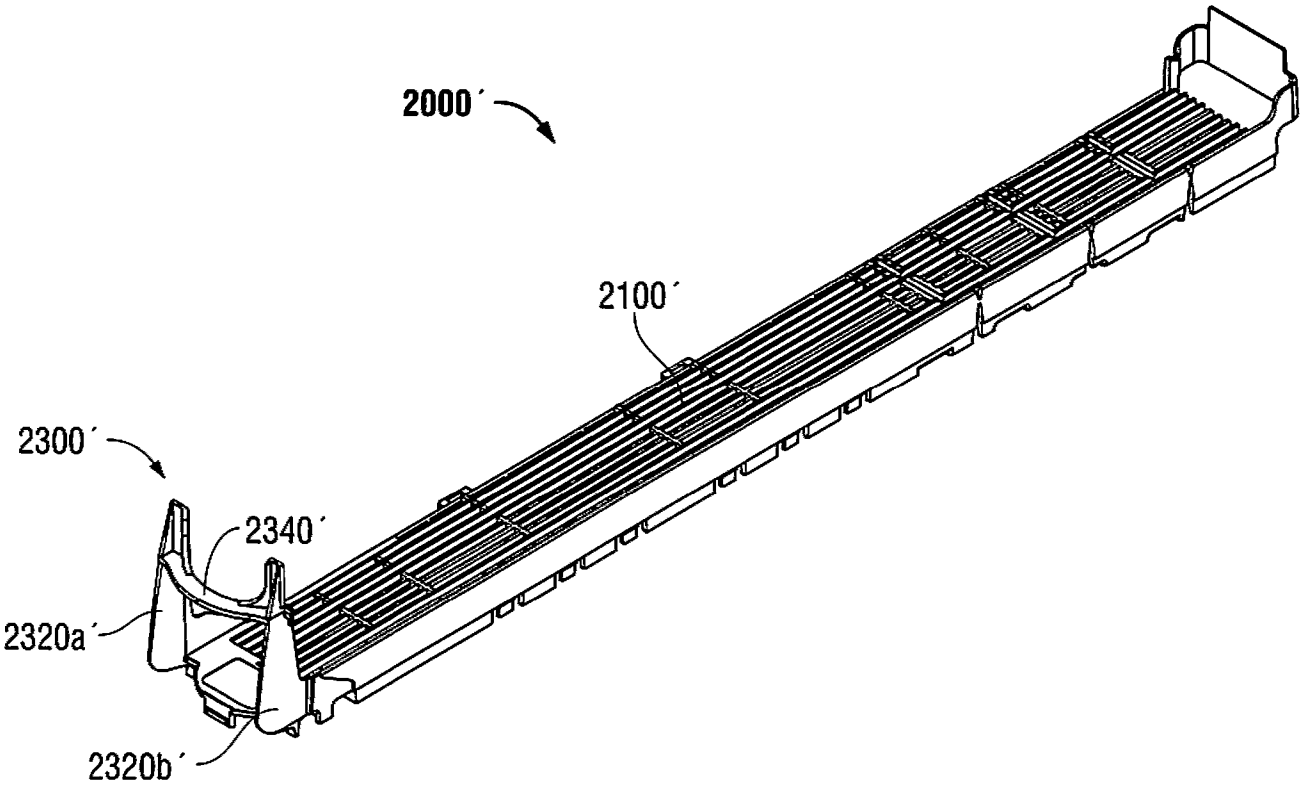
FIG. 10 is a perspective view of a bottom member in accordance with an embodiment of the present disclosure.
Figure 11:
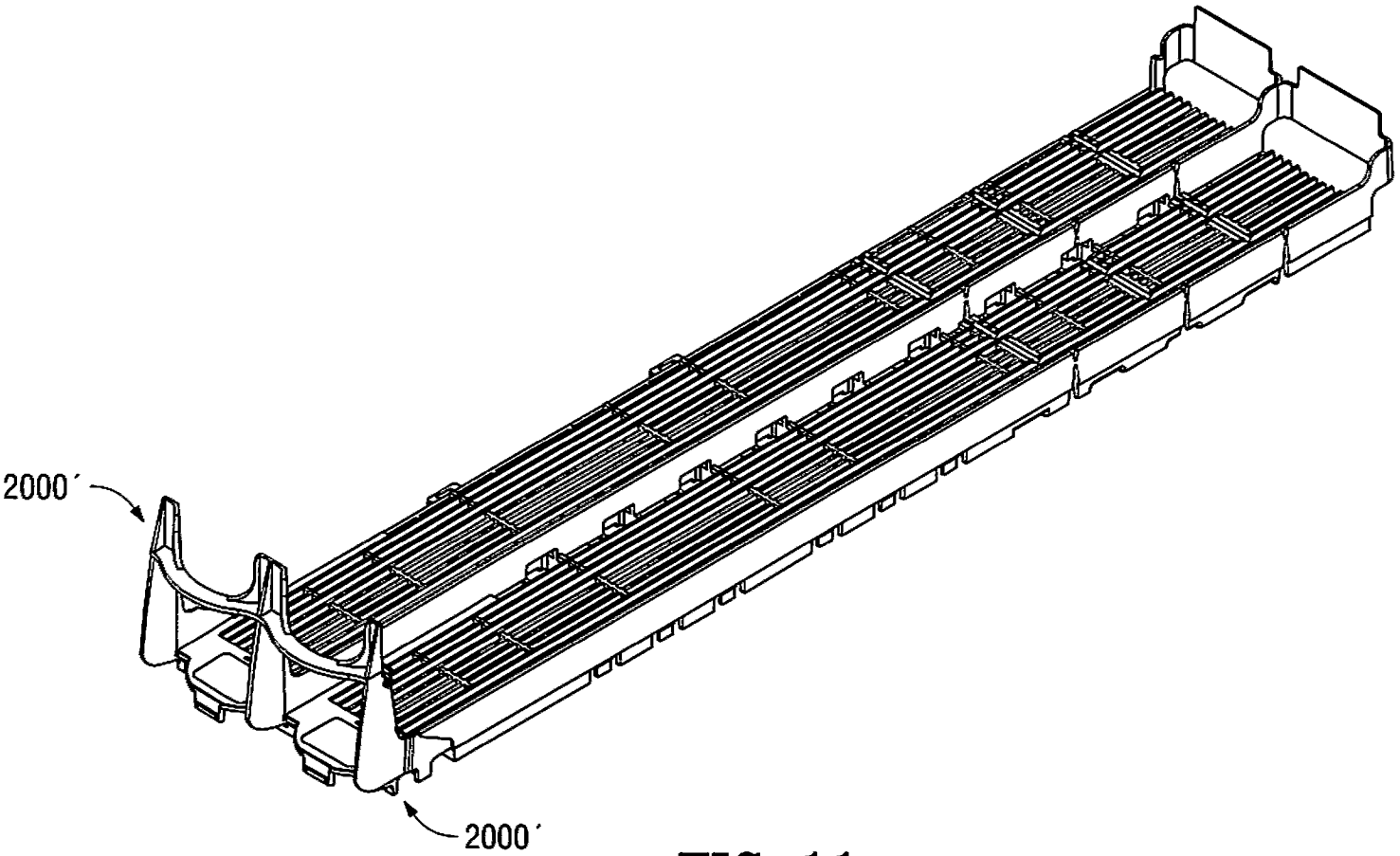
FIGS. 11 and 12 are perspective views of a plurality of the bottom members of FIG. 10 position adjacent each other.
Figure 12:
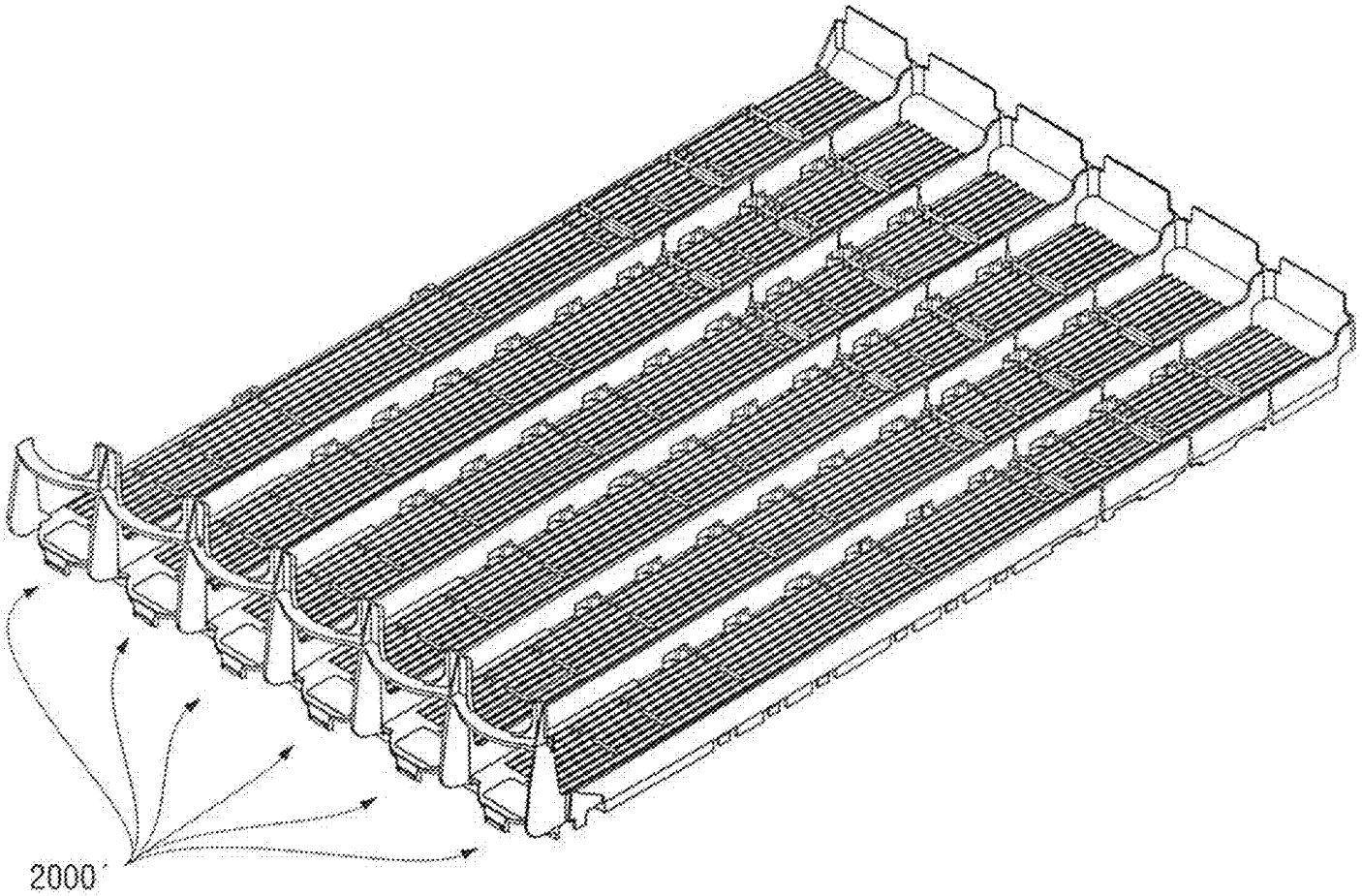

System 1000 includes two different embodiments of bottom members 2000, 2000'. A first embodiment of the bottom member 2000 is shown in FIGS. 7-9. In the first embodiment, the horizontal member 2340 of the proximal rail 2300 is located at the upper-most portion of the vertical arms 2320. A second embodiment of the bottom member 2000' is shown in FIGS. 10-12, where the horizontal member 2340' of the proximal rail 2300' is located between the upper-most portion of the vertical arms 2320*a*', 2320*b*' and the product-supporting surface 2100'. The use of either the first version or the second embodiment of the bottom members 2000, 2000' is determined by the size and/or shape of the product being supported.

With reference to FIG. 7, the distal rail 2500 extends upwardly and distally from the distal end of the product-supporting surface 2100 and is configured to help prevent products from falling off of the distal end of the bottom member 2000. The distal rail 2500 includes a pair of arms 2520*a*, 2520*b*, and a horizontal member 2540 supported by and extending between the arms 2520*a*, 2520*b*. When several bottom members 2000 are placed side-by-side (see FIGS. 8 and 9), the first arm 2520*a* of a first bottom member 2000 interlocks with the second arm 2520*b* of an adjacent bottom member 2000.

The rib 2700 extends upwardly from the product-supporting surface 2100 and is configured to help maintain products on the product-supporting surface 2100 (i.e., to help prevent products from moving horizontally off of the product-supporting surface 2100 or towards a horizontally-adjacent product-supporting surface 2100). When several bottom members 2000 including a rib 2700 are placed side-by-side (see FIGS. 8-9 and 22-12), a longitudinally-extending rib 2700 is located on each longitudinal side of the product-supporting surface 2100 (i.e., on both sides of the products supported by the product-supporting surface 2100) of all of the bottom members 2000 except for the left-most bottom member 2000. An additional rib 2700 may be added (e.g., snapped on) to the left side of the left-most bottom member 2000.

More particularly, the rib 2700 is configured such that it projects upwardly from the product-supporting surface 2100 and extends longitudinally therealong. The ribs 2700 project upwardly from the product-supporting surface 2100 a distance that enables horizontally-adjacent products to contact (or substantially contact) one another. That is, the ribs 2700 are sized such that the entire rib 2700, including its upper-most edge 2720, is able to fit under the widest portion of the product, thus allowing the rib 2700 to take advantage of the space produced by the contour of the product (e.g., beverage bottle). More particularly, the distance between adjacent ribs 2700 is dimensioned to be less than the widest portion of the product held on the product-supporting surface 2100.

Figure 13:
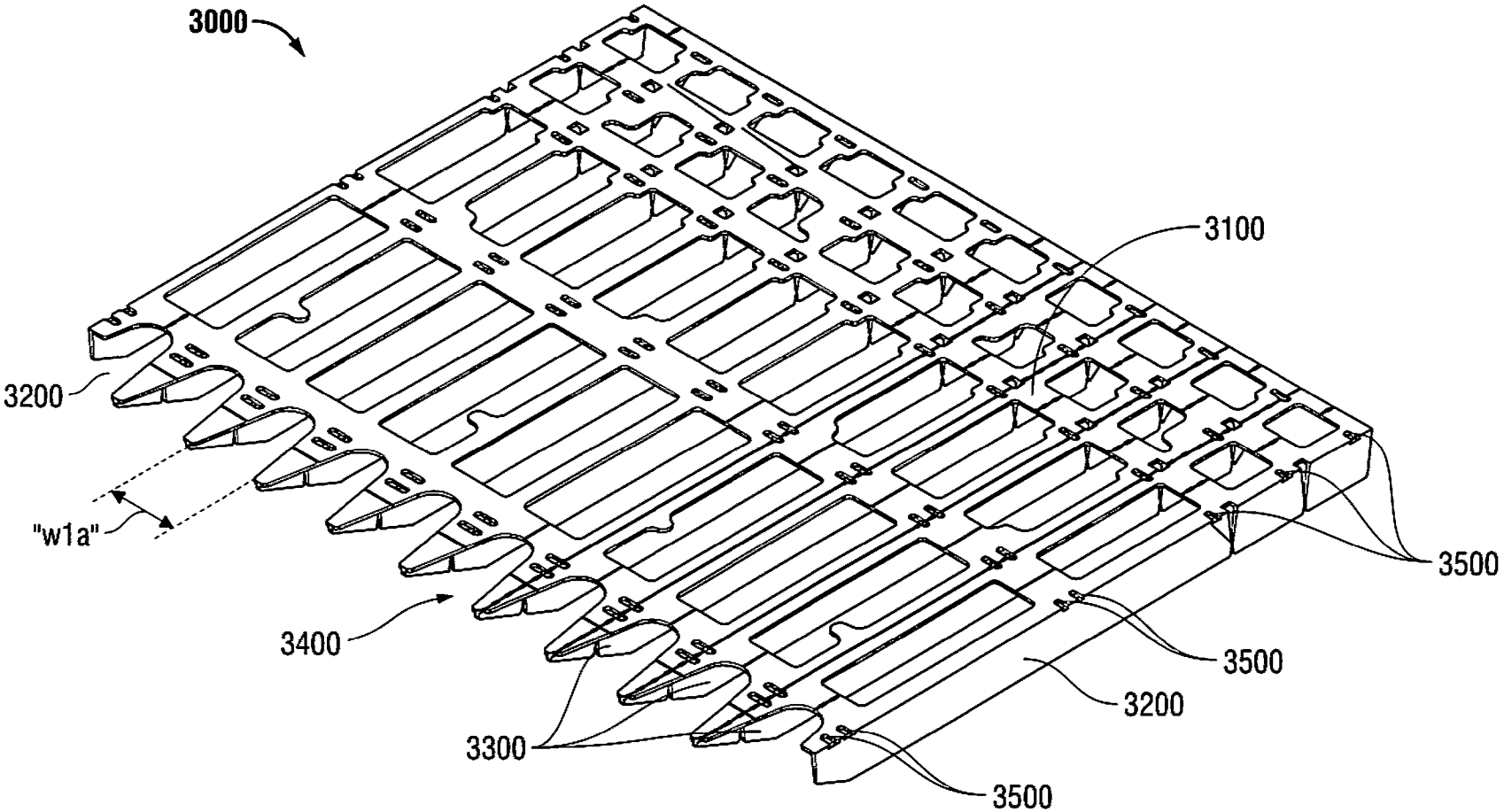
FIG. 13 is a perspective view of a plurality of top members in accordance with an embodiment of the present disclosure.

The top member 3000 is shown in FIG. 13 and is configured to help guide a top portion of the products (e.g., the cap/neck area of a bottle) in a distal-to-proximal direction. More particularly, the top member 3000 includes an upper surface 3100, two end members 3200, and several downwardly-depending channel walls 3300, with each pair of adjacent channel walls 3300 defining a channel 3400 therebetween. The width "w1*a*" of each channel 3400 is dimensioned to allow the neck area of a product (e.g., the cap of the bottle) to fit therein and to freely slide along the length of the channel 3400. In use, a single top member 3000 is used to guide a plurality of horizontally adjacently positioned products (i.e., one row of products per each channel 3400).

With particular reference to FIGS. 14 and 15, system 1000 is configured for use on a shelving system (e.g., gondola shelves) in a retail environment. To install the system 1000 on a shelving system, a user places the bottom member 2000 onto the top portion of a store shelf "S1." The top member 3000 is secured to the bottom of a second shelf "S2," which is above the bottom member 2000, by using a fastening device, such as wire ties "T" (see FIG. 15). More particularly, each wire tie "T" is threaded through an opening (e.g., one of openings 3500 in FIG. 13), and around a portion of the shelf "S2." (While only the outside/lateral openings are labeled in FIG. 13, for clarity, all of the openings, including the interior openings are configured to receive a fastening device engaged therewith.) In a disclosed embodiment, all of the wire ties "T" that are used to secure the top member 3000 to the bottom of the shelf "S2" are cinched tight such that the top member 3000 cannot move vertically with respect to the shelf "S2" that it is secured to. To change the height between the bottom member 2000 and the top member 3000, a user must move one or both of the associated shelves "S1", "S2." Additionally, as can be appreciated, a second bottom member is positionable on top of shelf "S2," and a second top member is positionable from a third shelf (not explicitly shown) which is positioned above shelf "S2."

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A product display unit for displaying a plurality of products thereon, the product display unit comprising:

a bottom member including a product-supporting surface, the bottom member being configured to be positioned on a first product-supporting shelf;

a first rib projecting upwardly from the product-supporting surface and extending longitudinally along the bottom member;

a second rib projecting upwardly from the product-supporting surface and extending longitudinally along the bottom member, such that a distance is defined between the first rib and the second rib; and a top member disposed in juxtaposed relation with the bottom member and being configured for suspension from a second product-supporting shelf, the top member including a longitudinally extending channel having a width, the smallest width of the channel being greater than a width of a top-most portion of a product configured to be supported by the bottom member, wherein the top member is fixed from vertical movement with regard to the second product-supporting shelf;

wherein the distance between the first rib and the second rib is dimensioned to be less than the widest portion of a product configured to be supported by the bottom member between the first rib and the second rib.

2. The product display unit of claim 1, wherein an upper-most edge of the first rib extends between about 0.25 inches and about 1.25 inches from the product-supporting surface.

3. The product display unit of claim 1, wherein the first product-supporting shelf and the second product-supporting shelf are substantially identical to each other.

4. The product display unit of claim 1, wherein the first product-supporting shelf and the second product-supporting shelf are substantially parallel to one another.

5. The product display unit of claim 1, further comprising a second bottom member configured to be positioned on the second product-supporting shelf.

6. The product display unit of claim 5, wherein the top member is fixed from vertical movement with regard to the second bottom member.

7. A system for displaying bottles, the system comprising:

a first product-supporting shelf;

a second product-supporting shelf vertically spaced apart from the first product-supporting shelf and disposed substantially parallel with respect to the first product-supporting shelf;

at least one bottom member including a product-supporting surface and being configured for positioning on the first product-supporting shelf; and at least one top member configured for suspension from the second product-supporting shelf, the top member including a longitudinally extending channel having a width, the channel configured to guide a top-most portion of a product configured to be supported by the bottom member, wherein the top member is fixed from vertical movement with regard to the second product-supporting shelf.

8. The system of claim 7, wherein the smallest width of the channel is greater than a width of a top-most portion of a product configured to be supported by the bottom member.

9. The system of claim 7, wherein the bottom member includes a plurality of ribs, each rib projecting upwardly from the product-supporting surface and extending longitudinally along the bottom member, wherein two adjacent ribs define a distance therebetween, and wherein the distance between adjacent ribs is dimensioned to be less than a widest portion of a bottle configured to be supported by the bottom member between the adjacent ribs.

10. The system of claim 9, wherein the upper-most edge of each rib is configured to occupy the space under a contour of a bottle.

11. The system of claim 9, wherein the first product-supporting shelf and the second product-supporting shelf are substantially identical to each other.

12. The system of claim 9, further comprising a second bottom member configured to be positioned on the second product-supporting shelf.

13. The system of claim 12, wherein the top member is fixed from vertical movement with regard to the second bottom member.

14. A method of displaying items, comprising:

providing a first shelf and a second shelf;

providing a first bottom member;

positioning the first bottom member on an upper surface of the first shelf;

providing a first top member;

suspending the first top member from beneath the second shelf such that the first top member is fixed from vertical movement with regard to the second shelf;

positioning a product on the first bottom member such that a top-most portion of the product is positioned adjacent the first top member; and moving the second shelf to change a vertical distance between the first bottom member and the first top member.

15. The method of claim 14, further comprising positioning a second bottom member on an upper surface of the second shelf.

16. The method of claim 14, wherein the first shelf and the second shelf are substantially identical to each other.

17. The method of claim 14, wherein the first bottom member includes a plurality of ribs, each rib projecting upwardly from a product-supporting surface and extending longitudinally along the first bottom member, wherein two adjacent ribs define a distance therebetween, and wherein the distance between adjacent ribs is dimensioned to be less than the widest portion of the product positioned on the first bottom member; and wherein the first top member includes a longitudinally extending channel having a width, the channel configured to guide the top-most portion of the product positioned on the first bottom member.

* * * * *